US006655690B1

(12) United States Patent
Oskwarek

(10) Patent No.: US 6,655,690 B1
(45) Date of Patent: Dec. 2, 2003

(54) METHOD FOR PLAYING A CASINO CARD GAME

(76) Inventor: Anthony Oskwarek, 14 Slocum Rd., Clinton, CT (US) 06413

( * ) Notice: Subject to any disclaimer, the term of this patent is extended or adjusted under 35 U.S.C. 154(b) by 0 days.

(21) Appl. No.: 10/215,638

(22) Filed: Aug. 9, 2002

(51) Int. Cl.[7] ..... A63F 1/00

(52) U.S. Cl. ..... 273/292; 273/274; 273/309; 463/13

(58) Field of Search ..... 273/292, 274, 273/309; 463/13

(56) References Cited

U.S. PATENT DOCUMENTS 5,072,946 A * 12/1991 Miller ..... 273/292
5,324,041 A * 6/1994 Boylan et al. ..... 273/292
5,364,105 A * 11/1994 Jones ..... 273/292
5,374,067 A * 12/1994 Jones ..... 273/292
5,380,012 A * 1/1995 Jones et al. ..... 273/292
5,928,081 A * 7/1999 Bochichio et al. ..... 463/13
5,934,675 A * 8/1999 Handelman et al. ..... 273/292
5,975,529 A * 11/1999 de Keller ..... 273/292
6,042,118 A * 3/2000 Poitra ..... 273/292
6,070,873 A * 6/2000 Perkins ..... 273/292
6,182,968 B1 * 2/2001 Wilkinson ..... 273/292
6,234,485 B1 * 5/2001 Perkins ..... 273/292
6,311,979 B1 * 11/2001 Andrews ..... 273/292
6,325,375 B1 * 12/2001 Potter et al. ..... 273/292
6,382,628 B2 * 5/2002 Stern ..... 273/292
6,390,474 B1 * 5/2002 Terminel et al. ..... 273/292
6,406,024 B1 * 6/2002 Perkins ..... 273/292
6,481,717 B1 * 11/2002 Richardelle ..... 273/292
6,536,768 B2 * 3/2003 Caputo ..... 273/292
6,575,467 B1 * 6/2003 Kal ..... 273/292

* cited by examiner

*Primary Examiner*—Benjamin H. Layno
*Assistant Examiner*—D Collins
(74) *Attorney, Agent, or Firm*—Raymond A. Nuzzo

(57) ABSTRACT

A method of playing a card game comprising the step of providing at least one set of playing cards comprising a plurality of different card suits. Each suit includes a plurality of cards wherein each card has a particular value. All of the suits having in common cards with the same values. The method further includes the step of each player placing an initial game bet and, if desired, an optional bet. Next, the dealer deals, in an initial deal, a face-up card to each player. The dealer does not deal himself a card in the initial deal. The dealer then removes a single card from the set of playing cards, places the single card face up and designates this card as a community card. Next, the value of the community card is summed with the value of each card held by each player to produce a an opening hand value for each player. The community card and each player's opening dealt card determine the outcome of any optional bets made by those players. Payoffs are made or withdrawn by the dealer. Any player whose hand value exceeds a predetermined hand value is required to surrender his or her bets to the dealer and to withdraw from play. Next, the dealer then deals a face up card to himself and it is summed with the community card to produce a dealer's hand value. Winnings are provided to each player based on that player's game bet if that player has a hand value that is less than or equal to the first predetermined hand value and greater than the dealer's hand value, or if the player has a hand value that is less than or equal to the predetermined hand value and the dealer's hand value exceeds the predetermined hand value.

20 Claims, 1 Drawing Sheet

METHOD FOR PLAYING A CASINO CARD GAME

BACKGROUND OF THE INVENTION

1. Field of the Invention

The present invention generally relates a method for playing a card game.

2. Description of Related Art

Currently, casinos use a variety of games for wagering. Many of these games are varieties of mechanical or electronic slot machines. Despite the popularity of slot machines of various types, poker, blackjack or twenty-one, keno, baccarat, craps and other traditional games played at a table are the foundation of casino play. Players are known to enjoy the novelty of new table games because the old games have become too well known by the players or because the players perceive some of the traditional games as being overly complicated. Moreover, since table games usually have larger stakes than slot machines, casinos have an interest in developing new table games for the clientele. Card games are one of the most popular types of table games available at casinos. Prospective players are always looking for new card games that are challenging and exciting. On the other hand, casinos and wagering establishments are interested in card games that will (i) attract more players, (ii) create player loyalty, and (iii) increase revenues to the casinos and wagering establishments.

What is needed is a new and card game that meets the needs of the players and casinos or wagering establishments. Accordingly, it is an object of the present invention to provide a new method for playing a card game that is challenging, exciting and entertaining.

It is another object of the present invention to provide a new and improved method for playing a card game that is short in duration so as to provide casinos or wagering establishments with increased revenues.

It is another object of the present invention to provide a new and improved method for playing a card game that eliminates any potential for a dealer to inadvertently or otherwise influence the outcome of the game.

It is another object of the present invention to provide a new and improved method for playing a card game that attracts more players.

It is another object of the present invention to provide a new and improved method for playing a card game that is easy to learn.

Other objects and advantages of the present invention will be apparent to one of ordinary skill in the art in light of the ensuing description of the present invention.

SUMMARY OF THE INVENTION

The present invention is directed to, in one aspect, a method of playing a card game comprising the step of providing a table having a playing station for a dealer and playing stations or positions for a plurality of players. Each player station comprises a card playing area and a betting area comprising a game betting zone and an optional betting zone. The method further comprises the step of providing at least one set of playing cards comprising a plurality of different card suits. Each suit includes a plurality of cards wherein each card has a particular value. All of the suits having in common cards with the same values. The method further includes the step of each player placing an initial game bet in that player's corresponding game betting zone and also, if desired, an optional bet in that player's corresponding betting zone. Next, the dealer deals, in an initial deal, a face-up card to each player. The dealer does not deal himself a card in the initial deal. The dealer then removes a single card from the set of playing cards, places the single card face up and designates this card as a community card. Next, the value of the community card is summed with the value of each card held by each player to produce an opening hand value for each player. The community card and each player's opening dealt card determine the outcome of any optional bets made by those players. Payoffs are made or withdrawn by the dealer. Any player whose hand value exceeds a predetermined hand value is required to surrender his or her bets to the dealer and to withdraw from play. The remaining players are provided with the opportunity to draw additional cards to form new hand values. Again, any player whose new hand value exceeds a predetermined hand value is required to surrender his or her bets to the dealer and to withdraw from play. Next, the dealer then deals a face up card to himself and it is summed with the community card to produce a dealer's hand value. Winnings are provided to each remaining player based on that remaining player's game bet if that remaining player has a hand value that is less than or equal to the first predetermined hand value and greater than the dealer's hand value, or if the remaining player has a hand value that is less than or equal to the predetermined hand value and the dealer's hand value exceeds the predetermined hand value.

BRIEF DESCRIPTION OF THE DRAWINGS

These and other features and advantages will become appreciated as the same becomes better understood with reference to the specification, claims and FIG. 1 which illustrates one embodiment of a game table with which the card game of the present invention is played.

DESCRIPTION OF THE PREFERRED EMBODIMENTS

Figure 1:
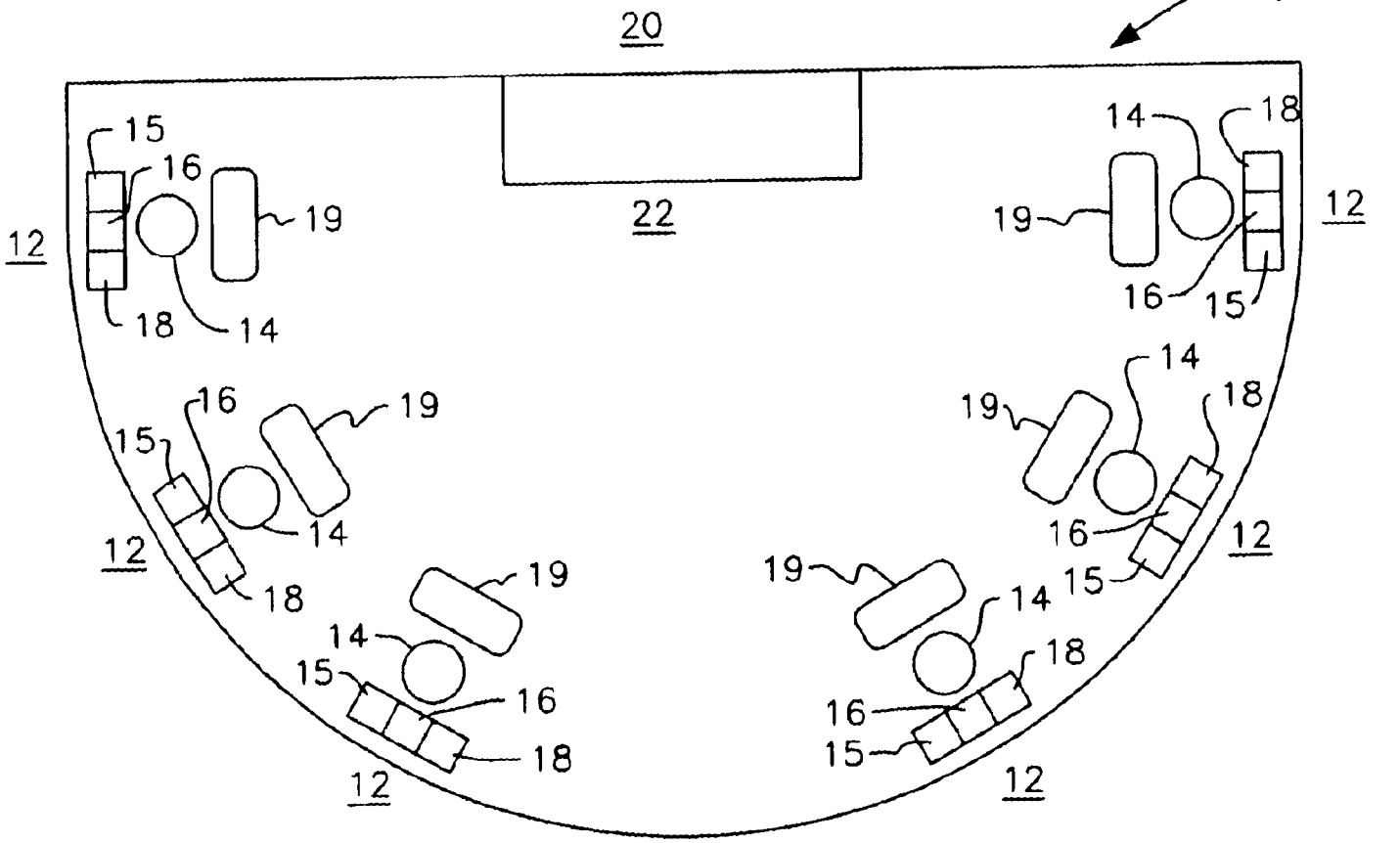

The card game of the present invention can be played with up to six players plus the dealer. A single player may multiple hands. The players are sitting or standing in respective player stations or positions spaced about the periphery of the gambling table. In one embodiment, the table has a generally semi-circular shape and includes a dealer playing station and a plurality of player areas or playing stations about the opposite side of the table that is across from the dealer station. Each player's station has a player card area and betting zones for receiving game bets or game wagers and optional or jackpot bets. The table with which the card game of the present invention is played is described in the ensuing description.

In a preferred embodiment, the cards are preferably dealt from a set of twenty four cards. In a preferred embodiment, the card game is played with at least twenty sets of cards wherein each set has twenty four cards (i.e. 480 cards in total). Each set of playing cards comprises a plurality of different card suits. Each suit includes a plurality of cards wherein each card has a particular value. All of the suits have in common cards with the same values. In a preferred embodiment, the card game of the present invention is played with cards having the following values: Ace, Two, Three, Four, Five and Six. In a preferred embodiment, Aces have a value of one and the remaining cards retain their face value. It is to be understood that the card game of the present invention may be played with a different quantity of sets of cards and each set may have more or less than twenty four cards.

In one embodiment, all of the sets of cards are contained in a shoe, known in the art, from which the dealer may draw one card at a time. In another embodiment, all of the sets of cards are contained in an automatic card shuffler.

As used herein, the terms "wager" and "bet" have the same meaning and are used interchangeably.

As used herein, the term "hand value" is defined as the sum of any dealt card(s) combined with the community card.

As used herein, the term "winning hand" is defined as a hand that has a hand value that is greater than the dealer's hand value and less than a first predetermined hand value. In one embodiment, the first predetermined hand value is ten.

Referring to FIG. 1, there is shown one embodiment of game table 10 that is used in playing the card game of the present invention. Game table 10 has a plurality playing stations or positions 12 wherein each playing station or position corresponds to a particular player. Game table 10 includes areas 14 for receiving player's game bets (or game wagers). Game table 10 further includes optional betting areas 15, 16 and 18. A player cannot place an optional bet without making a game bet. Each player's cards are positioned in a card playing area designated by the numeral 19. Game table 10 further includes dealer station 20 and dealer player area 22. Referring to FIG. 1, optional betting area 15 is preferably indicated by a color. In one embodiment, the color is "Red". Although other colors may be used as well, the ensuing discussion is in terms of optional betting area 15 having the color "Red". If a player places a wager in the "Red" area 15, and the community card and the card initially dealt to the player are both Red, the player wins. In one embodiment, the pay-off is 2 to 1. However, other pay-off ratios are possible. If either or both the community card and the player's initial game card is "Black", the player loses his optional bet.

Referring to FIG. 1, optional betting area 18 is preferably indicated by another color. In one embodiment, the color is Black. Although other colors may be used, the ensuing description is in terms of optional betting area 18 being colored "Black". If a player places a wager in the Black betting area 18, and the community card and the card initially dealt to the player are both Black, the player wins. In one embodiment, the pay-off is 2 to 1. However, other pay-off ratios are possible. If either or both the community card and the player's first game card is Red, the player loses his optional bet.

Referring to FIG. 1, optional betting area 16 is for placing bets that the player's hand value (e.g. value of the community card plus the value of the cards dealt to the player) will equal a particular hand value that is in a predetermined set of hand values. In one embodiment, the set of predetermined hand values comprises three hand values. In one embodiment, the three hand values are seven, eleven, and twelve. Thus, the player wins if the community card summed with the player's initial game card to yield seven, eleven, and twelve. In one embodiment, the pay-off ratio is 2 to 1. Other pay-off ratios are possible. A combination hand value other than seven, eleven, and twelve results in a losing bet.

A player may optionally place an optional bet on the line that separates optional betting areas 15 and 16, or on the line that separates optional betting areas 16 and 18. Thus, the player can play two optional betting areas simultaneously. A player wins when the criteria of both optional bets are satisfied. For example, if a player placed a bet on the line separating betting zone 15 and 16, the player would win if the if the community card summed with the player's initial game card to yield seven, eleven, and twelve, and the community card and the card initially dealt to the player are both Red. In one embodiment, the pay-off ratio for winning bets on the line that separate optional betting zones is 5 to 1.

The casino can establish minimum and maximum game and optional bets.

The game starts by each player placing an initial game wager and any optional bets on game table 10 in the designated area for game bets. In a preferred embodiment, once game bets are made, the bets cannot be removed, increased or decreased.

After all the players make their game bets and optional bets, the dealer deals, in an initial, a face-up card to each player. Next, the dealer removes a single card from the set of playing cards and designates that card as a community card. The community card is used by all players and the dealer to create an opening hand. The dealer does not deal himself or herself a card in the initial deal. The dealer preferably deals the cards to each player, starting from the dealer's left to right. In the next step, all opening hands of the players are evaluated to determine if any player has a hand value that exceeds a predetermined value. Any hand value exceeding a predetermined value is referred to herein as a "Break". In a preferred embodiment, the predetermined value is ten. Any player that has an opening hand value that exceeds ten must surrender his or her bets and withdraw from play.

Players remaining in the game have three options: Stay, Draw or Split.

The Draw option allows players to request an additional card. A finger or hand motion towards the player's cards will signal the dealer that the player is requesting another card. A player can continue to draw additional cards as long as the player's hand value does not exceed that first predetermined hand value (i.e. ten). If a player's hand value exceeds the first predetermined hand value, that player automatically loses all bets and must withdraw from play.

The Stay Option allows a player to stay with an existing hand and not request additional cards. A waving motion of the player's hand signals the dealer that no additional card is being requested.

In order to exercise the Split Option, a player must be dealt two identical valued cards that do not exceed the first predetermined hand value when summed with the value of the community card. If this scenario occurs, the player may split those two identical valued cards into two separate hands. Each hand comprises the community card and one of the identically valued cards. The player then places another game bet next to the initial game bet. Thus, each hand will have a corresponding game bet. Each hand is then played separately to its conclusion. In a preferred embodiment, a maximum of four "splits" are allowed. In a preferred embodiment, identical cards having values of five and six cannot be split into separate hands.

When all players have played and there are remaining players with hands that have are not exceeded a first predetermined hand value (i.e. 10), the dealer is then ready to play. The dealer will remove the next card and turn it over. The dealer creates a total hand value by summing that card with the community card. If the total hand value exceeds the first predetermined hand value (i.e. 10), the dealer will automatically lose and any remaining player wins.

The dealer may exercise the Draw and Stay options, but may not exercise a Split option. In accordance with the invention, the dealer must exercise the Draw option if the Dealer's hand value is less than a second predetermined hand value. In a preferred embodiment, the second predetermined hand value is seven. In accordance with the present invention, the dealer must exercise the Stay option if the hand value of the community card and the card initially dealt to the dealer equals a third predetermined hand value that is less than the first predetermined hand value (i.e. ten) and greater than the second predetermined hand value (i.e. seven). In a preferred embodiment, the third predetermined hand value is eight.

A tie occurs when a player and the dealer each have a hand value that is equal to a particular hand value that is in a set of predetermined hand values. A tie between the dealer's hand value and a player's hand value is referred to herein as a "Push". In a preferred embodiment, the set of predetermined hand values comprises the first predetermined hand value (i.e. ten), the third predetermined hand value (i.e. eight), and a fourth predetermined hand value that is less than the first predetermined hand value, and greater than the third predetermined hand value. In a preferred embodiment, the fourth predetermined hand value is nine. Thus, a Push can occur when the hand value of the tying hands is eight, nine or ten. In a preferred embodiment, a Push occurring when a player and the dealer both have hand values equal to eight, nine or ten is neither a win nor a loss. Thus, a player does not lose his initial game bet.

Table I shows pay-off ratios for different hand value scenarios. Table II shows pay-off ratios based on optional bets or wagers. A used herein, the term "Hard Ten" refers to the scenario wherein the card initially dealt to the player is a five and the community card is a five, and the player's hand value is greater than the dealer's hand value. A player can achieve "Hard Ten" only with the initially dealt card and the community card. A player cannot achieve a "Hard Ten" with more than one dealt card.

The term "Soft Ten", as used herein, shall refer to any hand value that equals ten other than a "Hard Ten". An example of a "Soft Ten" is hand comprising a community card having a value of four and a dealt card having a value of six. Another example of a "Soft Ten" is a hand comprising a community card having a value of two and dealt cards of two, three, and three. In a preferred embodiment, any player with a winning "Soft Ten" will be paid 3 to 2 on a game bet.

TABLE I

| Hand Value Scenario | Pay-Off |
|---|---|
| Winning "Hard Ten"<br>Community Card Value = 5<br>Player's Card Value = 5 | 2 to 1 |
| Soft Ten<br>Any Hand That Has A Value Of 10 Other Than A "Hard Ten" | 3 to 2 |
| Push | |
| Player's Hand Value: 10 | No Pay-Off |
| Player's Hand Value: 9 | No Pay-Off |
| Player's Hand Value: 8 | No Pay-Off |
| All Other Winning Hands | 1 to 1 |

TABLE II

| Optional Bet Scenario | Pay-Off |
|---|---|
| Winning "Red" Bet | 2 to 1 |
| Winning "Black" Bet | 2 to 1 |
| Winning "7, 11, 12" Bet | 2 to 1 |

TABLE II-continued

| Optional Bet Scenario | Pay-Off |
|---|---|
| Winning Bet On Line Separating Betting Zones | 5 to 1 |

However, it is to be understood that other pay-off ratios are possible in addition to the pay-off ratios show in Tables I and II.

In one embodiment, a bonus pay-off is provided to a player when that player has a winning hand value of ten and the hand is comprised of five "2" cards. In one embodiment, the bonus pay-off is in terms of a pay-off ratio based on the player's game wagers (e.g. 4 to 1, 10 to 1, etc.) In another embodiment, the bonus pay-off is in terms of a lump sum cash payment to the player.

In an alternate embodiment, the dealer may "burn" the first card out of a "shoe" at the start of each game. This card is not revealed to the players and is placed face down into the used card tray. A game then begins with players being dealt a face-up game card from the dealer's left to right.

It is to be understood that the method of playing a card game of the present invention can be played: (i) in a casino or other wagering establishment in a manner similar to conventional card games, i.e. "live table version" wherein a group of players and a dealer are positioned at a gaming table, (ii) on electronic video gaming machines located in a casino other wagering establishment, or (iii) on linked, electronic video gaming machines located in a casino or wagering establishment. Furthermore, the present invention can be implemented in a lottery format, e.g. the player's hands and dealer's hand are printed on a "scratch" type ticket that are sold to members of the public.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method of playing a card game comprising the steps of:

providing at least one set of playing cards comprising a plurality of different card suits, each suit includes a plurality of cards wherein each card has a particular value, all of the suits having in common cards with the same values;

each player placing an initial game wager;

the dealer dealing, in an initial deal, a face-up card to each player, the dealer not dealing himself a card in the initial deal;

removing a single card from the set of playing cards, placing the single card face up and designating this card as a community card;

summing the value of the community card with the value of the cards held by each player to produce an opening hand value for each player;

requiring any player whose hand value exceeds a first predetermined hand value to surrender his or her bets to the dealer and to withdraw from play, the players not withdrawing from play being remaining players;

thereafter, the dealer dealing an initial face-up card to himself;

summing the value of the community card with the value of the dealer's card to provide a dealer's hand value; and providing winnings to a remaining player based on the remaining player's game wager if the remaining player has a hand value that is less than the first predetermined hand value and greater than the dealer's hand value, or the remaining player has a hand value that is less than the first predetermined hand value and the dealer's hand value exceeds the first predetermined hand value.

2. The method according to claim 1 further comprising the step of providing each player an opportunity to place an optional bet.

3. The method according to claim 2 further comprising the step of providing winnings to a player based on that player's optional bet if the all of the cards in a player's opening hand have a first color.

4. The method according to claim 3 further comprising the step of providing winnings to a player based on that player's optional bet if the all of the cards in a player's opening hand have a second color.

5. The method according to claim 4 further comprising the step of providing winnings to a player based on that player's optional bet if the hand value of the player's opening hand is equal to hand value that is in a predetermined set of hand values.

6. The method according to claim 1 further including the step of providing each player with an opportunity to draw at least one additional card.

7. The method according to claim 6 further including the steps of summing the value of each remaining player's additional cards with that remaining player's opening hand value to arrive at a new hand value.

8. The method according to claim 7 further including the steps of:

determining whether the new hand value exceeds the first predetermined hand value;

requiring any player whose new hand value exceeds the first predetermined hand value to surrender his or her bets to the dealer and to withdraw from play; and providing winnings to a remaining player based on the remaining player's game wager if the remaining player has a new hand value that is less than the first predetermined hand value and greater than the dealer's hand value, or the remaining player has a new hand value that is less than the first predetermined hand value and the dealer's hand value exceeds the first predetermined hand value.

9. The method according to claim 6 further comprising the steps of:

determining if a player is dealt two cards that are the same in value;

summing the value of the two cards having identical values with the community card to produce a sum value;

determining if the sum value exceeds the first predetermined hand value;

converting the two cards that have the same value into two separate hands if the sum value does not exceed the first predetermined hand value; and thereafter, each player having two separate hands placing an additional game wager that is equal to the initial game wager.

10. The method according to claim 9 further comprising the steps of:

determining if the identically valued cards have values that are equal to a value that is in a predetermined set of values; and denying a player an opportunity to form the two separate hands if the identically valued cards have values that are equal to a value that is in the predetermined set of values.

11. The method according to claim 8 further including the steps of:

requiring the dealer to hold if the dealer's initial face-up card is greater than a predetermined maximum value providing the dealer with an opportunity to draw at least one additional card if the dealer's initial face-up card is less than or equal to the predetermined maximum value; and summing the value of the additional card with the dealer's hand value to form a dealer's new hand value.

12. The method according to claim 11 further including the step of providing winnings to each remaining player based on that remaining player's game wager if that remaining player has a new hand value that is less than the first predetermined hand value and greater than the dealer's new hand value, or that remaining player has a new hand value that is less than the first predetermined hand value and the dealer's new hand value exceeds the first predetermined hand value.

13. The method according to claim 1 further including the step of determining if any of the player's hand values equals the dealer's hand value.

14. The method according to claim 13 further including the step of determining if the hand values of the players whose hand values equal the dealer's hand value are within a predetermined set of hand values.

15. The method according to claim 14 further including the step of returning initial game bets to the players whose hand values equal the dealer's hand value and are within the predetermined set of hand values.

16. The method according to claim 15 wherein one of the hand values within the predetermined set is the first predetermined hand value.

17. The method according to claim 2 further including step of providing a table having a playing station for a dealer and playing stations for a plurality of players, each player station comprising a card playing area and a betting area comprising a game betting zone and an optional betting zone, each betting zone comprising a plurality of optional betting zones, a first one of the plurality of optional betting zones being configured to receive bets that all of the cards in a player's hand will be a first color, a second one of the plurality of optional betting zones being configured to receive bets that all of the cards in a player's hand will be a second color, a third one of a plurality of optional betting zones being configured to receive bets that a player's hand value will be equal to a hand value in a predetermined set of hand values.

18. The method according to claim 1 wherein the first predetermined value is ten.

19. The method according to claim 1 wherein the at least one set of cards comprises twenty sets of cards and each set of cards has twenty four cards.

20. The method according to claim 1 wherein the values of the cards in the at least one set of cards is between Ace and six, inclusive, and wherein the Ace has a value of one and the remaining cards retain their face value.

* * * * *